US006491183B1

(12) United States Patent
Huang

(10) Patent No.: US 6,491,183 B1
(45) Date of Patent: Dec. 10, 2002

(54) SWIVELLING GLASS

(75) Inventor: I-Chen Huang, Tainan (TW)

(73) Assignee: Tien Yang Enterprise Co., LTD, Tainan (TW)

( * ) Notice: Subject to any disclaimer, the term of this patent is extended or adjusted under 35 U.S.C. 154(b) by 0 days.

(21) Appl. No.: 09/919,964

(22) Filed: Aug. 2, 2001

(51) Int. Cl.[7] ..... B65D 25/00

(52) U.S. Cl. ..... 220/629; 220/631; 220/636; 211/74

(58) Field of Search ..... 220/629, 630, 220/631, 636; D11/74

(56) References Cited

U.S. PATENT DOCUMENTS 2,659,920 A * 11/1953 Bogan et al. ..... 132/73.5
2,748,952 A * 6/1956 Fleit ..... 211/74
2,905,351 A * 9/1959 Lerner ..... 119/61
3,526,335 A * 9/1970 Swett et al. ..... 215/10
5,586,647 A * 12/1996 Barta et al. ..... 206/217
5,662,241 A * 9/1997 Sorensen ..... 220/630
5,862,938 A * 1/1999 Burkett ..... 220/589
6,135,303 A * 10/2000 Schultz ..... 215/371

* cited by examiner

*Primary Examiner*—Joseph M. Moy
(74) *Attorney, Agent, or Firm*—Rosenberg, Klein & Lee

(57) ABSTRACT

A swivelling glass is generally composed of a cup and a base. The bottom portion of the cup has a swivel section which has a sphere surface at its bottom portion thereof, and a slanting surface at its bottom end. The base comprises a hole on top portion with an arcuate surface corresponding to the sphere surface of the swivel section of the cup, thus the cup may swivel on top of the base.

2 Claims, 10 Drawing Sheets

SWIVELLING GLASS

BACKGROUND OF THE INVENTION

1. Field of the Invention

This invention relates to a glass, and more particularly to a glass which enables the cup to swivel with respect to the base of the glass.

2. Description of a Prior Art

A conventional glass is generally composed of a cup A seating on top of a base B. The cup A has a hollow body to contain drinks while the base B is to support the cup A to stand on a table or so forth. This design has a few shortcomings:

1. It is inconvenient for a user to lift the glass in an angle in order to drink.
2. When a child is drinking with a straw, due to his/her height is shorter, it is necessary for him/her or his/her parent to lift the glass in an angle, this is also inconvenient.
3. When lying on a bench mat or a poor chair, a user has to sit up and lift the glass to drink.
4. It is not attractive to a user.

In view of this and many others, the inventor has invented a glass which has a swivel cup to solve the above-mentioned shortcomings.

SUMMARY OF THE INVENTION

It is the primary object of the present invention to provide a swivelling glass, which is generally composed of a cup and a base. The bottom end of the cup has a swivel section which has a sphere surface, and a slanting surface at its outer end. The base comprises a hole on top portion with an arcuate surface corresponding to the sphere surface of the swivel section of the cup, thus when the cup is seated on the base, the swivel section of the cup and the arcuate surface of the hole in the base shall allow the cup to swivel in an angle.

It is another object of the present invention to provide a swivelling glass, which has grooves on the swivel section to increase elastic character of the swivel section.

It is a further object of the present invention to provide a swivelling glass, which has an attractive appearance to customers.

DETAILED DESCRIPTION OF THE PREFERRED EMBODIMENTS

Figure 1:
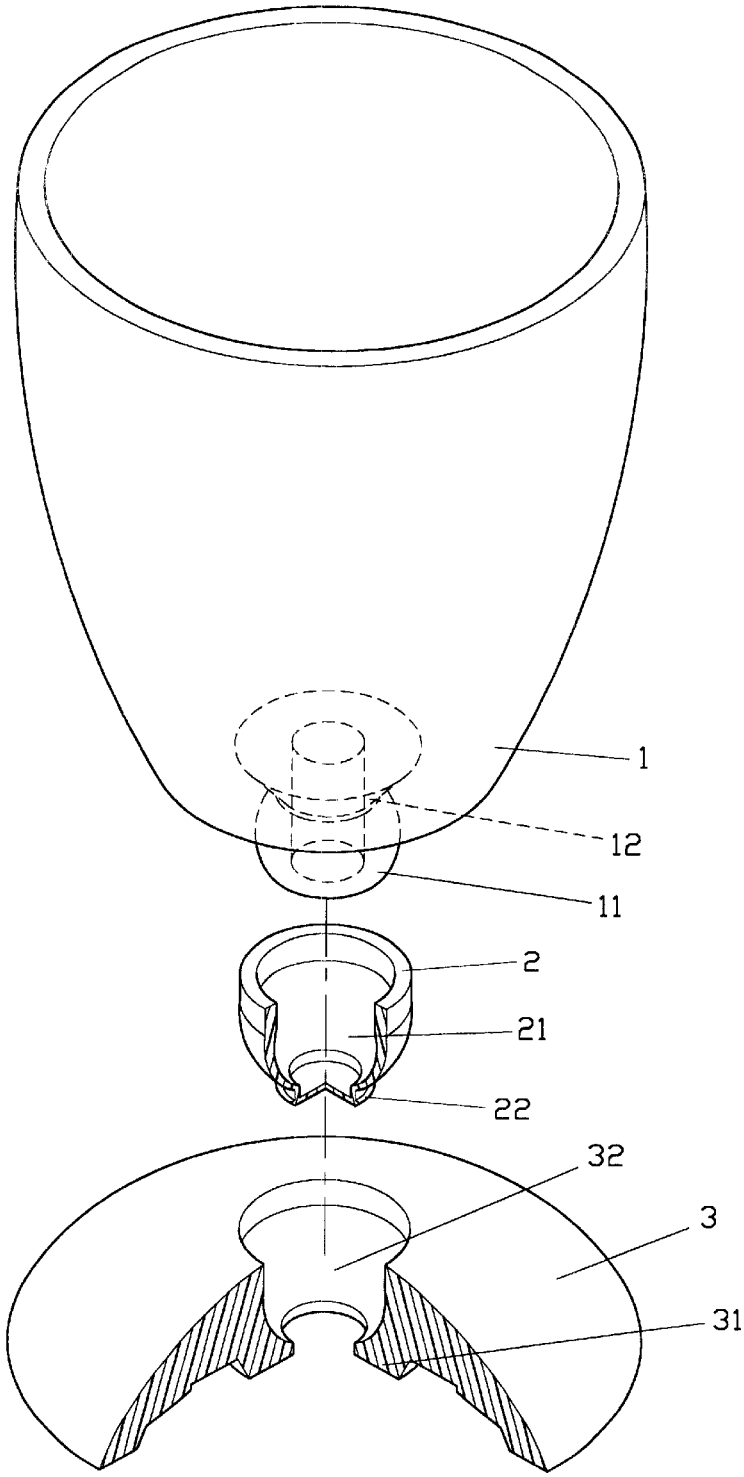
FIG. 1 is an exploded view of the present invention, partially sectioned.

A swivelling glass of the present invention, as shown in FIG. 1, is generally composed of a cup 1, a swivel seat 2 and a base 3.

The cup 1 has a hollow body with a swivel section 11 which has a sphere surface at its bottom portion thereof, and a slanting surface 12 at its bottom end.

The swivel seat 2 also comprises an arcuate surface 21 corresponding to the swivel section 11. The bottom end of the swivel seat 2 is sealed preventing liquid from penetration therein, and the bottom end edge of the swivel seat 2 is formed with a catch strip 22.

The base 3 has a smooth slanting outer surface with a solid block 31 at its bottom end, and a hole 32 at its center portion adapted to receive the swivel seat 2 therein.

Figure 2:
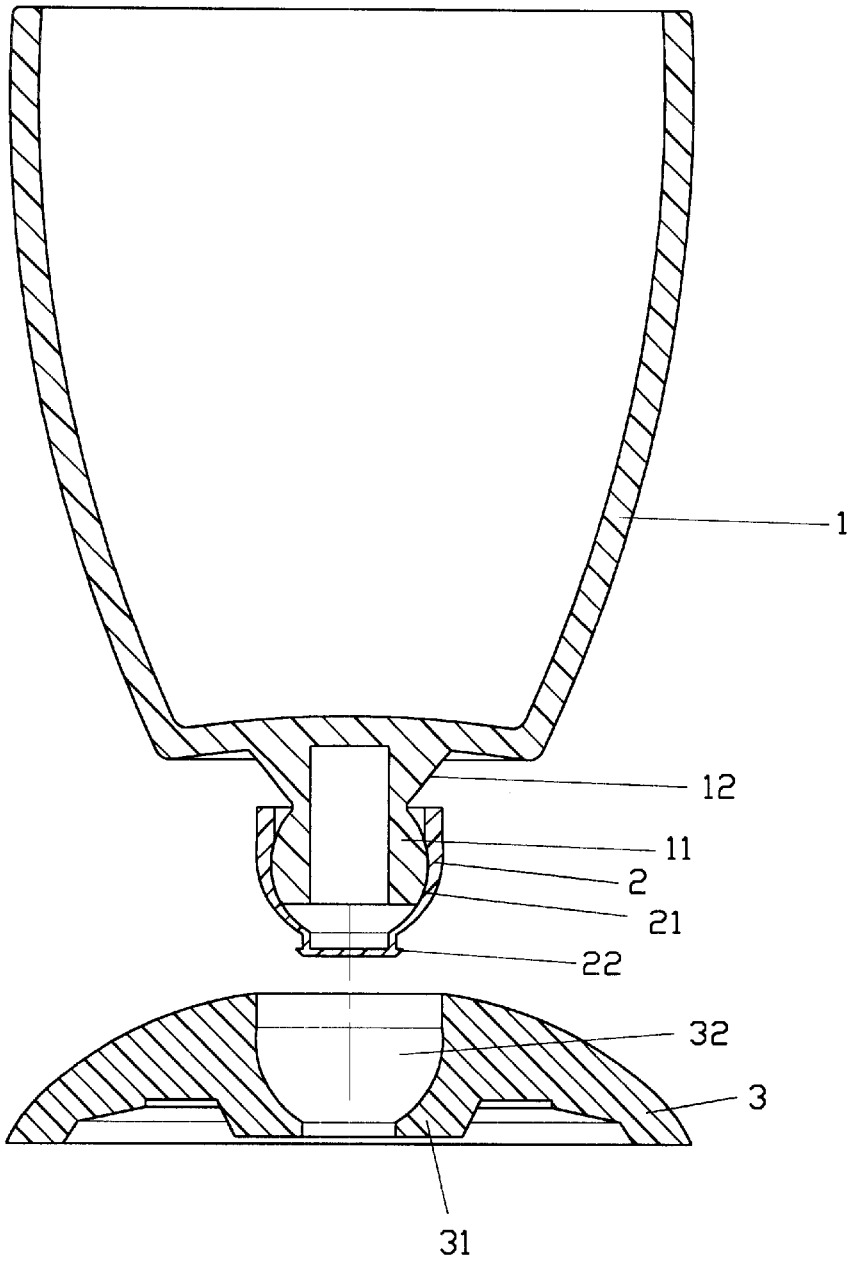
FIG. 2 is a side cross sectional view of FIG. 1.
Figure 3:
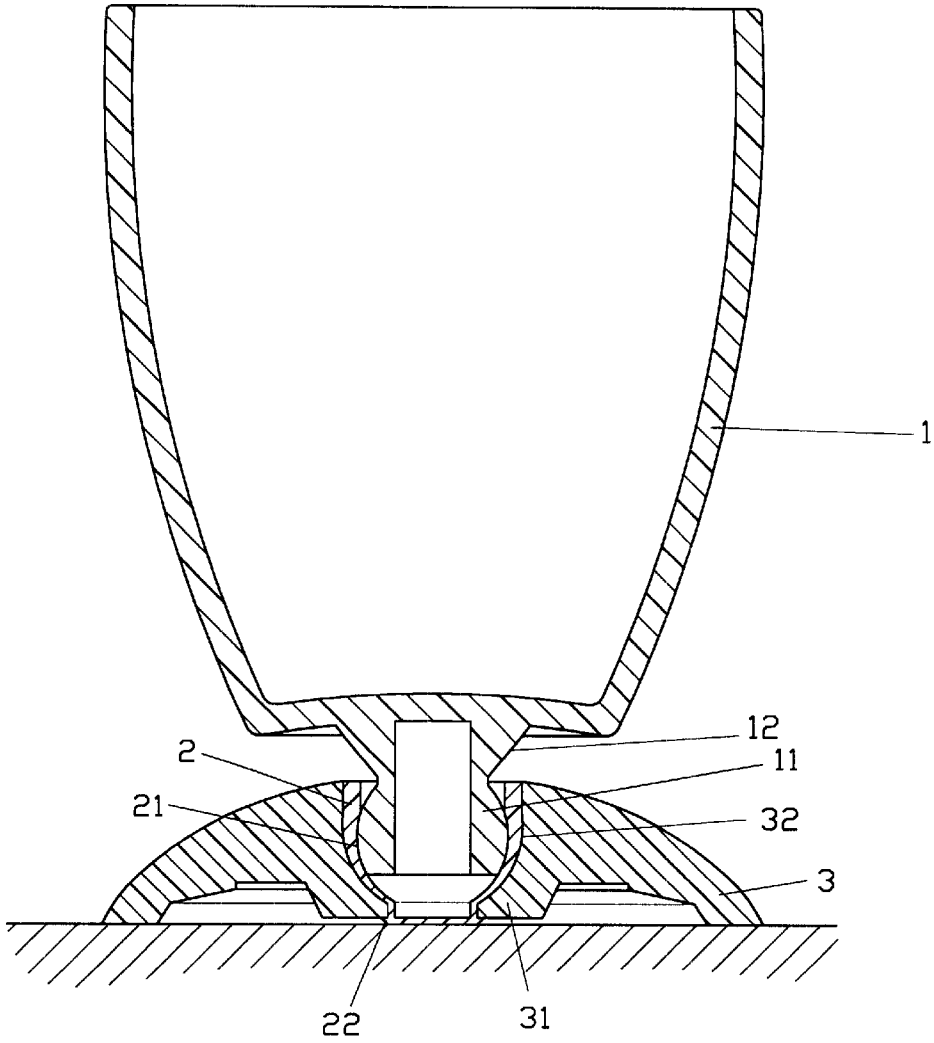
FIG. 3 is a side cross sectional view of the present invention, being assembled.

To assemble, as shown in FIG. 2, the swivel seat 2 is placed onto the swivel section 11 at the bottom end of the cup 1 and is secured thereto, and then the swivel seat 2 is pressed into the hole 32 of the base 3 with the catch strip 22 extending outwardly from the hole 31 and clipped with the block 31, as shown in FIG. 3. Due to the bottom end of the swivel seat 2 is sealed, it prevents liquid or a foreign object from penetrating therein.

Figure 4:
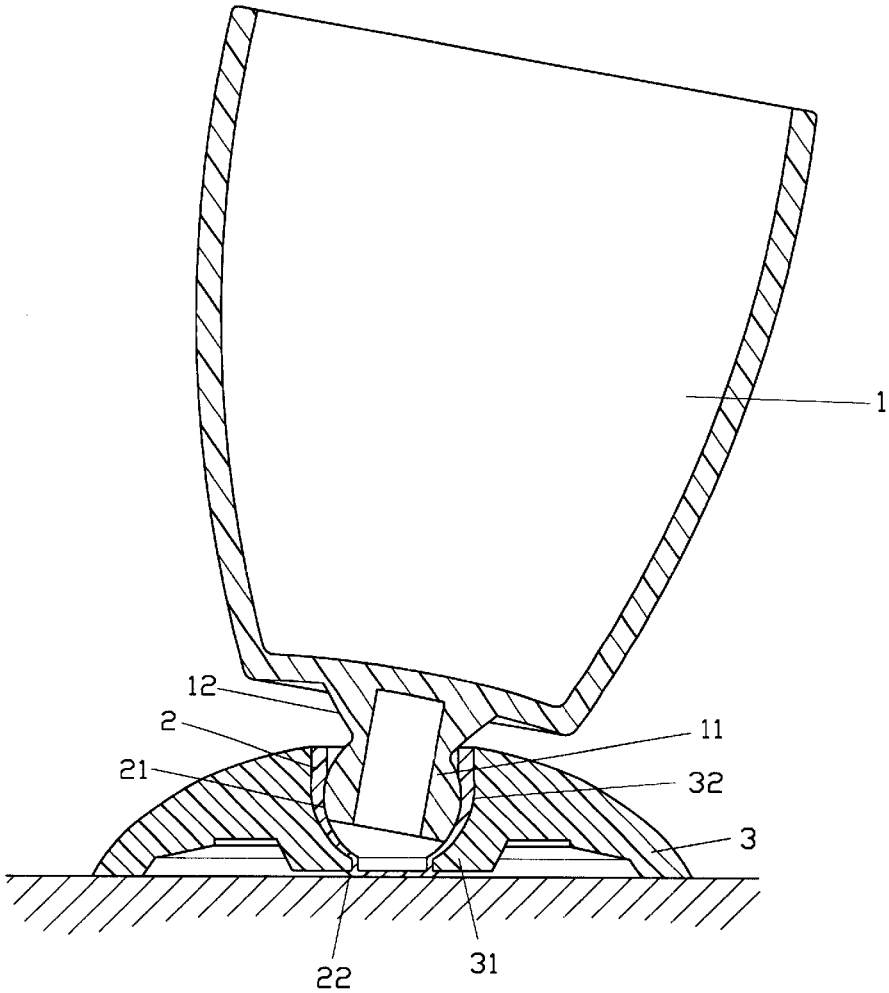
FIG. 4 is a side cross sectional view of the present invention with the cup inclined towards one direction.

In practice, the glass of the present invention, may be swung to any angle to its limits, as shown in FIG. 4, whereas upon the slanting surface 12 has reached to the top edge of the swivel seat 2, this rotation movement will be stopped, which is in an angle that prevents liquid from pouring out.

Figure 5:
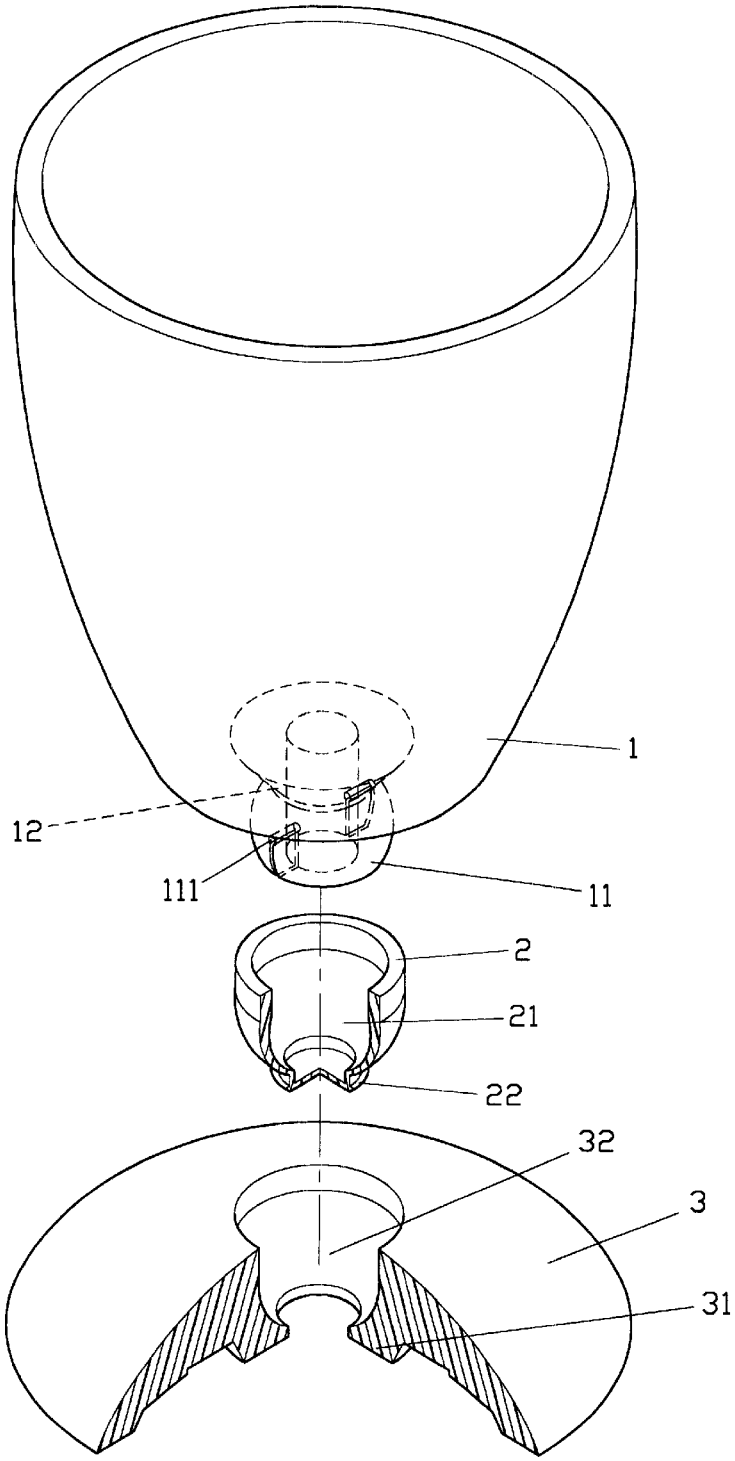
FIG. 5 is an exploded view of a first embodiment of the present invention, partially sectioned.
Figure 6:
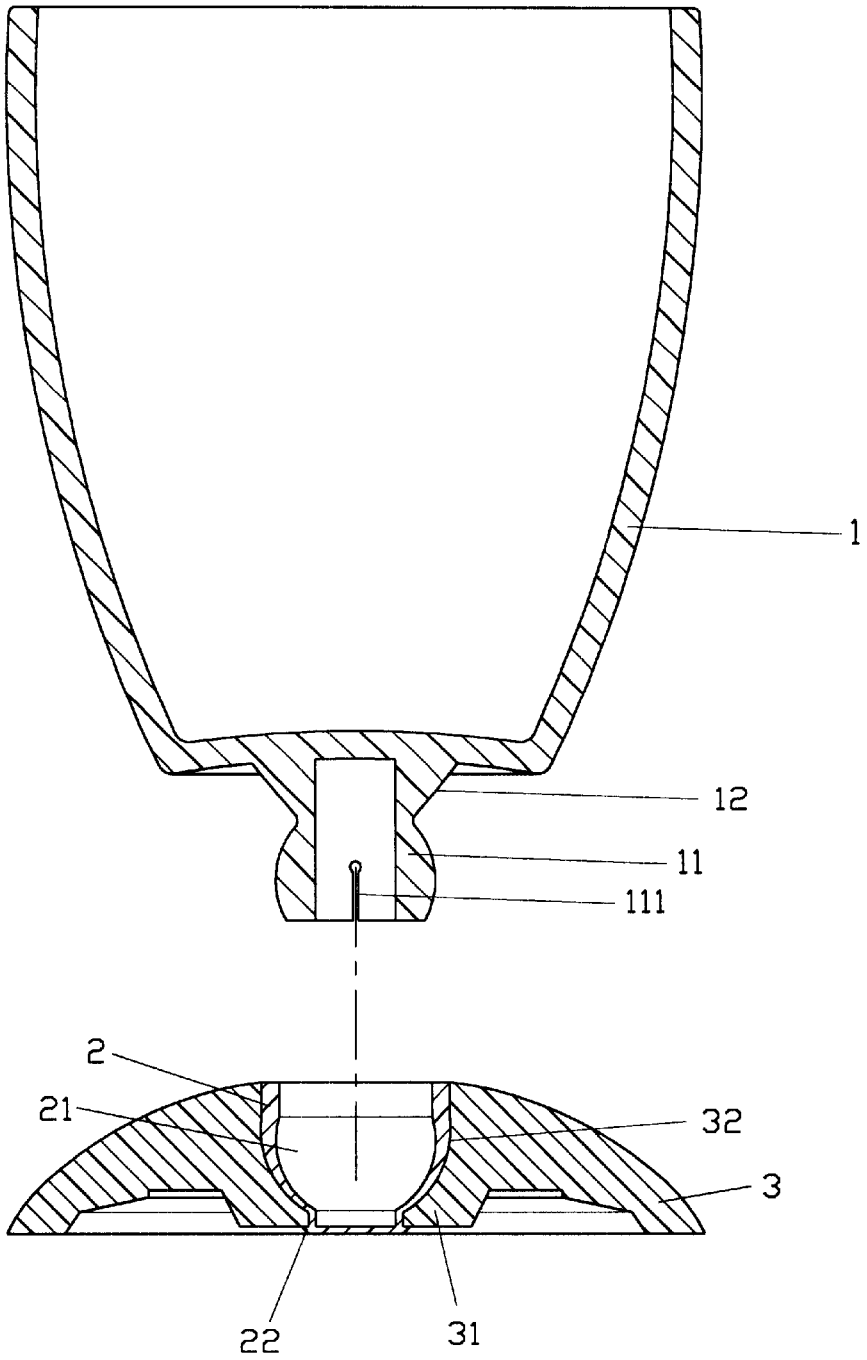
FIG. 6 is a side cross sectional view of FIG. 5.
Figure 7:
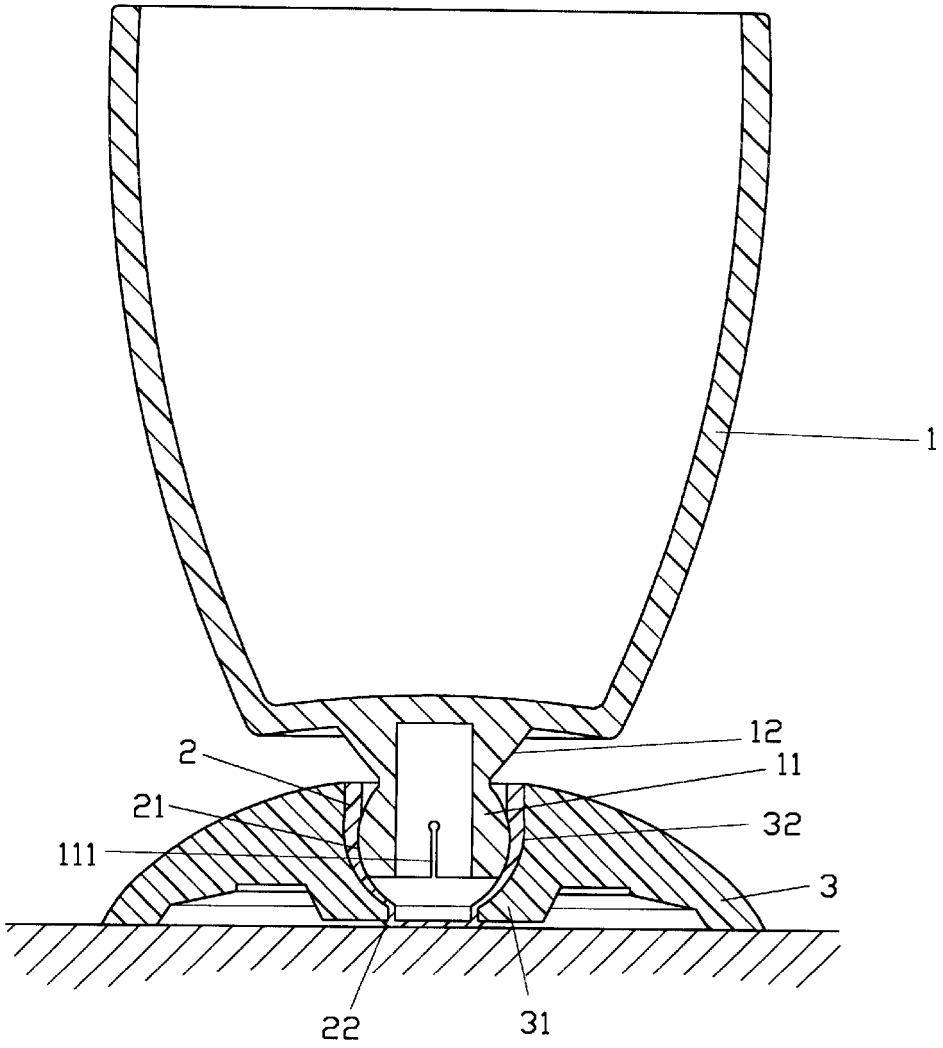
FIG. 7 is a side cross sectional view of FIG. 5, being assembled.

FIG. 5 has shown a second embodiment, which comprises a number of grooves 111 on the swivel section 11 of the cup 1, so that when assembling the present invention in according to the above mentioned method, as shown in FIGS. 5, 6, and 7, the grooves 111 shall provide elastic character, which facilitate installation of the swivel section 11 into the swivel seat 2, and the rotation as well.

Figure 8:
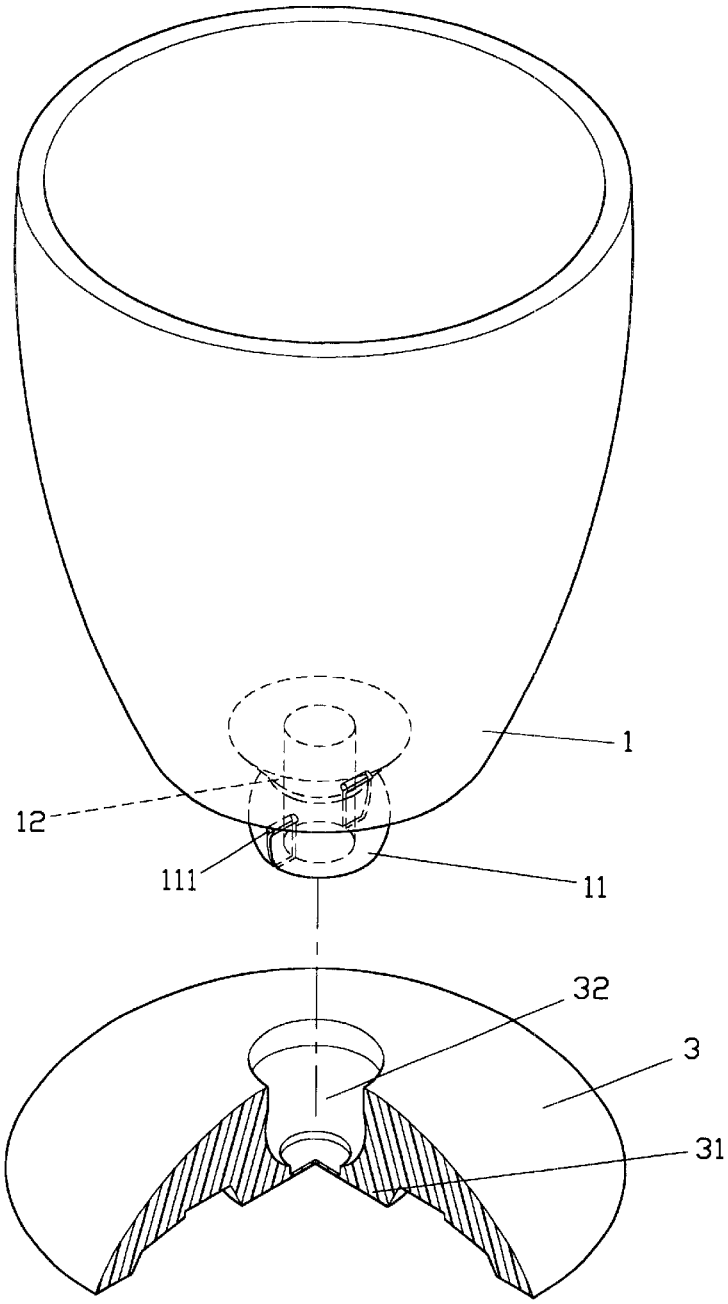
FIG. 8 is an exploded view of a second embodiment of the present invention, partially sectioned.
Figure 9:
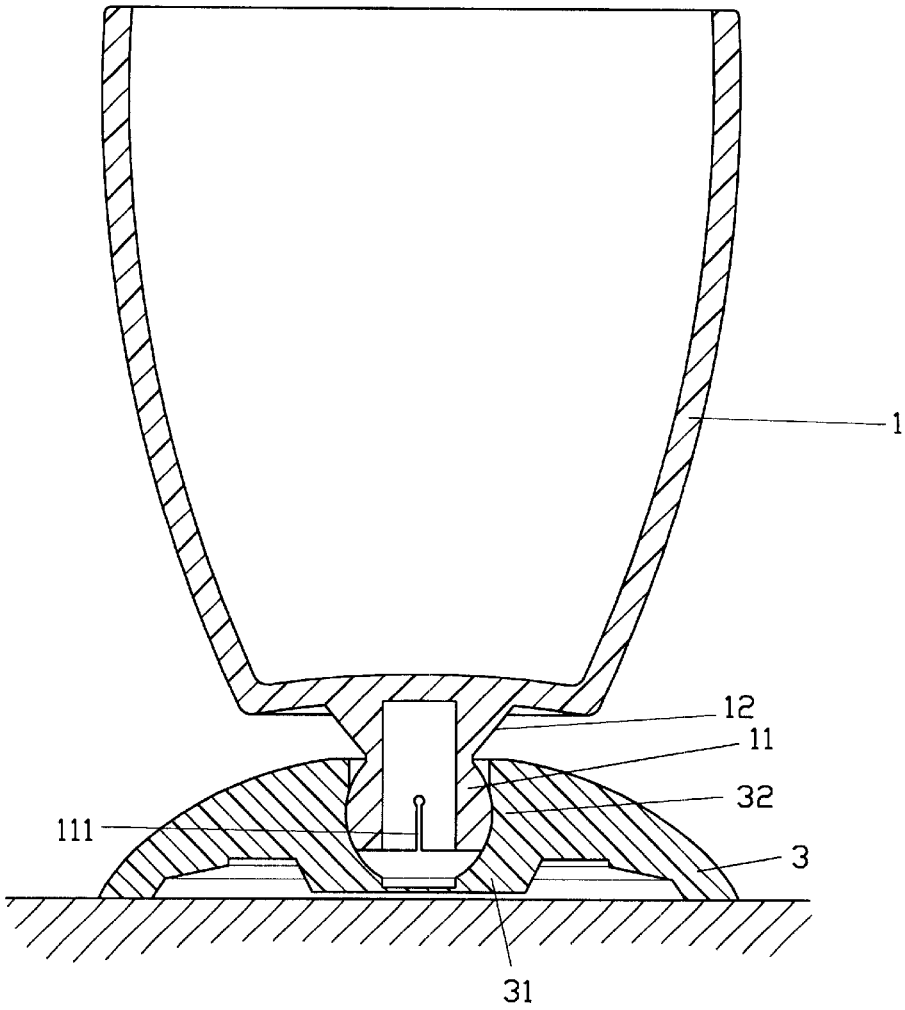
FIG. 9 is a side cross sectional view of FIG. 8, being assembled.
Figure 10:
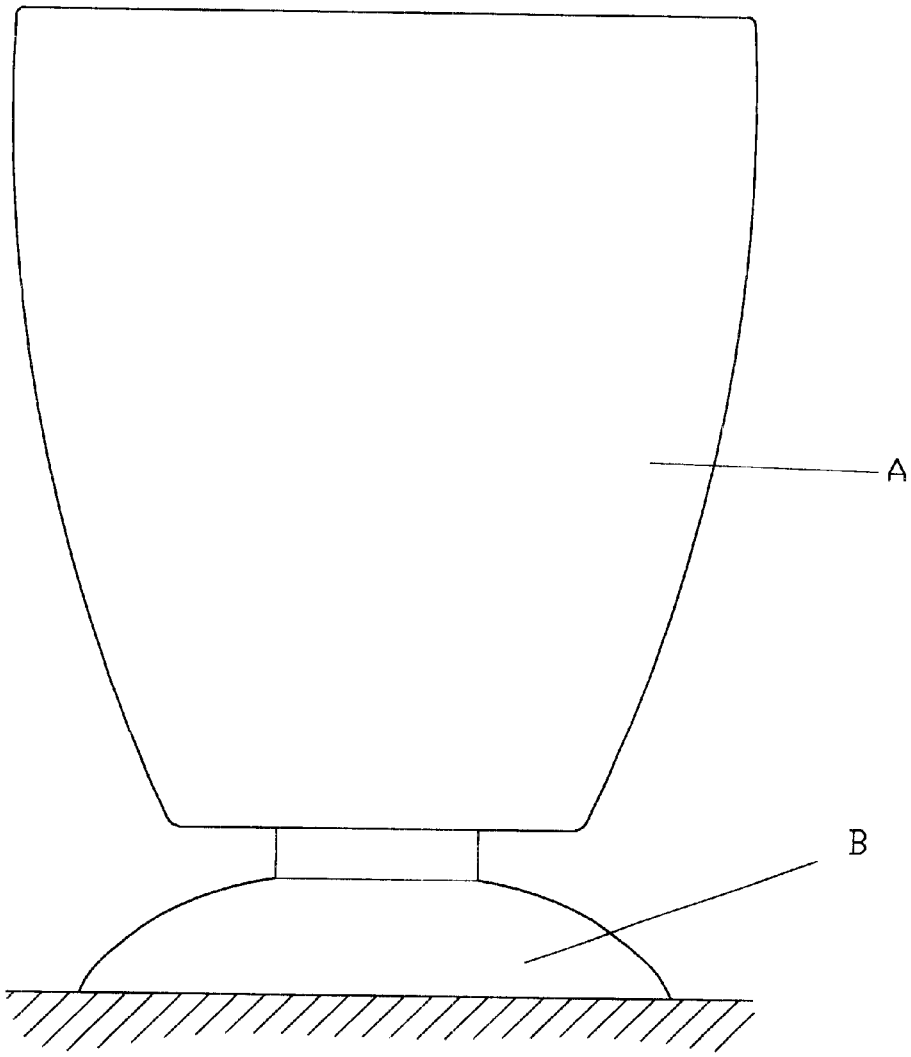
FIG. 10 (PRIOR ART)
FIG. 10 is a perspective view of a prior art.

Furthermore, the swivel seat 2 of the present invention may be formed integrally with the hole 32 of the base 3, as shown in FIG. 8, which also simplifies installation of the swivel section 11 into the hole 32 of the base 3, as shown in FIG. 9, whereas the grooves 111 shall facilitate installation.

I claim:

1. A swivelling glass comprising a cup and a base, wherein said cup comprising a swivel section having a sphere surface at its bottom portion and a slanting surface at its bottom end;

said base comprising a hole at its center portion adapted to receive a swivel seat corresponding to said sphere surface of said swivel section therein, said swivel seat being sealed at its bottom end and having a catch strip at its bottom edge corresponding to a block of said base, whereas when press said swivel section of said cup into said swivel seat in said hole of said base, said catch strip being clipped with said block of said base, and enabling said cup to rotate with respect to said base.

2. The swivelling glass, as recited in claim 1, wherein said cup comprises grooves on said swivel section of said cup to provide elastic character of said swivel section.

* * * * *